US006088564A

United States Patent [19]

Imes et al.

[11] Patent Number: 6,088,564

[45] Date of Patent: Jul. 11, 2000

[54] TRANSLATING TRIBOCHARGING BLADE

[75] Inventors: Edward P. Imes, Ontario; James G. Stenzel, Rochester, both of N.Y.

[73] Assignee: Xerox Corporation, Stamford, Conn.

[21] Appl. No.: 09/373,677

[22] Filed: Aug. 13, 1999

[51] Int. Cl.[7] ..... G03G 15/08

[52] U.S. Cl. ..... 399/284

[58] Field of Search ..... 399/272, 273, 399/274, 281, 283, 284

[56] References Cited

U.S. PATENT DOCUMENTS

| | | | |
|---|---|---|---|
| 4,516,850 | 5/1985 | Nishikawa . | |
| 4,555,172 | 11/1985 | Mogi | 399/273 |
| 4,699,495 | 10/1987 | Hilbert | 399/272 X |
| 4,777,904 | 10/1988 | Gundlach et al. | 399/281 |
| 4,796,057 | 1/1989 | Howard et al. . | |
| 5,233,390 | 8/1993 | Fujimoto | 399/274 X |
| 5,303,010 | 4/1994 | Takano et al. | 399/284 X |
| 5,517,289 | 5/1996 | Ito et al. . | |
| 5,758,232 | 5/1998 | Ikunami | 399/111 |
| 5,765,076 | 6/1998 | Ogata et al. | 399/100 |
| 5,799,229 | 8/1998 | Yokoyama et al. | 399/100 |
| 5,826,132 | 10/1998 | Damji et al. | 399/110 |

*Primary Examiner*—Susan S. Y. Lee
*Attorney, Agent, or Firm*—Andrew D. Ryan

[57] ABSTRACT

An assembly for use in a development unit including a mechanism and a member. A mechanism translates the member in a direction along the free edge. The member cooperates with a development roll and the mechanism cooperates with the roll and translates the member simultaneously with the rotation of the roll.

31 Claims, 13 Drawing Sheets

TRANSLATING TRIBOCHARGING BLADE

BACKGROUND OF THE INVENTION

This invention relates to electrostatographic reproduction machines, and more particularly to a development unit for use in an electrostatographic reproduction machine. Specifically this invention relates to such a development unit including a blade with a translating tribocharging blade.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically including toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit CRU. Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

In single component development as described above, the particle of toner is charged prior to development of the toner onto the photoreceptive drum by rubbing the particle between a charge-metering blade and the magnetic roll. The charged particles on the periphery of the magnetic roll are then transferred onto the photoconductive drum at the charged portions of the surface of the photoconductive drum or the latent image to form the developed image on the photoconductive drum. The developed image is then transferred onto the substrate or paper.

Referring now to FIG. 2, a typical prior art printing machine 1 is shown. To describe the electrphotogaphic process in greater detail, the imaging cycle of the printing machine 1 begins with a photoconductive drum 2. The drum 2 rotates in the direction of the arrow, and is charged by a charging device A. The charged portion of the drum 2 is then rotated to an exposing station B where either a light lens system or a raster optical scanner forms a latent image on the drum 2. The latent image corresponds to an image of a document positioned on a platen (not shown) or to output which is sent to the raster output scanner.

The portion of the drum 2 bearing the latent image is then rotated to the developer station C where the latent image is developed with developer material such as with charged single complement magnetic toner using a magnetic developer roll 4. A regulating member in the form of, for example, a regulating blade 7 is closely tangential positioned to the periphery of the drum 2 and is utilized to control the amount of toner on the drum 2.

The developed image on the drum 2 is then rotated to a near vertical transfer point at transfer station D where the toner image is transferred to a copy sheet fed along a copy sheet or substrate path. The copy sheet substrate with the transferred toner image is then directed to the fuser station E where the heated fuser roll 5 and pressure roll rotate to heat, fuse and fix the toner image onto the copy sheet substrate. The copy sheet substrate then, as is well known, may be selectively transported to an output tray (not shown) or to another post fusing operation.

The portion of the drum 2 from which to developed toner image was transferred is then advanced to the cleaning station F where residual toner and residual charge on the drum 2 are removed by for example a blade 6. The imaging cycle of the machine 1 using the drum 2 can then be repeated for former transferring another image as the clean portion of the drum 2 again comes under the charging station A.

The quality of the print copy from the printing machine is affected by many factors. One of these factors is the amount and evenness of the layer of toner on the periphery of the drum 2. Another related factor is the amount and evenness of charge on the toner around periphery of drum 2. A non-uniform layer and/or a non uniform charge on the periphery of the drum results in streaks in the copied sheet and particularly in non-uniformity in the solid areas.

The regulating blade 7 is primarily responsible for these factors. One reason that the evenness of the letter of toner and the evenness of charge on the toner may be nonuniform is that the regulating blade may be worn.

Wear on the blade 7 is inevitable in that the blade must be made from a material which will not damage the periphery of the drum. Since the drum 2 is made of a delicate material, the blade 7 must be made out a material which is non-abrasive to the drum and such a material may wear rapidly.

The following disclosures may be relevant to various aspects of the present invention:

U.S. Pat. No. 5,826, 132

Patentee: Damji, et al.

Issue Date: Oct. 20, 1998

U.S. Pat. No. 5,799,229

Patentee: Yokoyama, et al.

Issue Date: Aug. 25, 1998

U.S. Pat. No. 5,765,076

Patentee: Ogata, et al.

Issue Date: Jun. 9, 1998

U.S. Pat. No. 5,758,232

Patentee: Ikunami, et al.

Issue Date: May 26, 1998

U.S. Pat. No. 5,517,289

Patentee: Ito, et al.

Issue Date: May 14, 1996

U.S. Pat. No. 4,796,057

Patentee: Howard, et al.

Issue Date: Jan. 3, 1989

U.S. Pat. No. 4,516,850

Patentee: Nishikawa

Issue Date: May 14, 1985

U.S. Pat. No. 5,826,132 discloses a system for providing a plurality of process cartridges for developing with marking particles a latent image with common components. The system includes a housing and a member mounted to the housing for advancing the marking particles toward the latent image. The system also includes a first pan securable to the housing and defining a first cavity therebetween. The first cavity defines a first volume. The system also includes a second pan securable to the housing and defining a second cavity therebetween. The second cavity defines a second volume substantially different than the first volume. The housing, the member and the first pan are assembled to form a first process cartridge including the first volume. The housing, the member and the second pan are assembled to form a second process cartridge including the second volume.

U.S. pat. No. 5,799,229 discloses an image forming apparatus including a photoconductive drum, a charging roller which is held in pressured contact with the photoconductive drum, and a holder which holds a spreading blade having a free or unsupported end which is held in contact with the charging roller to spread toner and other particles which adhere to the surface of the charging roller. Preferably, there is a thin flexible film between the holder and the spreading blade. The spreading blade is held by the holder such that when the charging roller rotates, a frictional force pulls the spreading blade relative to the holder. This frictional force imposes a rotational moment on the spreading blade which reduces the force of the spreading blade against the charging roller when the charging roller rotates. In order to extend the life of the spreading blade and to achieve a uniform distribution of the particles on the charge roller, the spreading blade may be moved in a reciprocating motion along a plane tangential to the surface of the roller and/or along the length of the roller. The spreading blade spreads the toner and other particles which adhere to the surface of the charging roller into a thin uniform layer so that the charging roller uniformly charges the photoconductive drum.

U.S. Pat. No. 5,765,076 discloses a method of forming an electrostatic latent image includes printing operation and toner recovering operation. the printing operation includes charging, forming an electrostatic latent image, developing, and transferring operations. The toner recovering operation includes the step of charging the photosensitive drum in timed relation to the rotation of the photosensitive drum after printing operation so that reversely charged toner deposited on the charging roller migrates from the charging roller to the photosensitive drum. The toner migrated from the charging roller to the photosensitive drum is recovered into a developer. An apparatus for forming an image includes a charging roller, photosensitive drum, developing roller, and transfer roller. The apparatus further includes a reversely-charged-toner recovering device which causes the photosensitive drum to be charged in timed relation to the rotation of the photosensitive drum after printing operation so that the reversely charged toner deposited on the charging roller migrates to the photosensitive drum. The developer recovers the toner which has migrated to the photosensitive drum from the charging roller.

U.S. Pat. No. 5,758,232 discloses an image forming apparatus includes an image forming body, a developing device, a transfer device, a fixing device, and a processing device for image formation. The apparatus further includes a first body including the transfer device and a second body provided over the transfer device including the image forming body, and at least one of a processing device including a charger for charging the image forming body, the developing device, and a cleaning device for cleaning the image forming body. The second body is movable with respect to the first body, and movable between a first position in which an image formation can be carried out and a second position in which the second body is drawn out. The processing device can be drawn out from the second body when the second body is located at the first position.

U.S. Pat. No. 5,517,289 discloses an image forming apparatus having a unit for charging the surface of an image carrier uniformly with electricity, the charging unit being contacted by a conductive element which changes a polarity of toner adhering to the unit, a unit for forming an electrostatic latent image on the surface of the image carrier charged electrically, a unit for developing the electrostatic latent image formed on the surface of the image carrier to thereby form a toner image and a means for transferring and fixing the toner image to a transfer member. The developing unit includes a developing roller which is disposed so as to contact the image carrier. The developing roller is connected to a power source for charging the toner particles on the developing roller with electricity with the same polarity as the charging polarity of the image carrier, and for applying an electric potential to the developing roller so that the toner particles remaining on the developing roller are stuck to an image portion of the image carrier and the toner particles remaining on a non-image portion of the image carrier are attracted by the developing roller. The developing roller rotates in the direction opposite to that of the image carrier and a peripheral velocity of the developing roller exceeds 1.2 times that of the image carrier. Since the collected toner particles are not necessary to be disposed of, the environment is not polluted and the efficiency of using the toner is improved.

U.S. Pat. No. 4,796,057 discloses an apparatus for separating residual toner material from the surface of a reusable photoreceptor in a reproducing machine has a cleaner blade assembly including a cleaner blade in a holder. The cleaner blade assembly is movable between two positions. In a first position the blade operatively engages the photoreceptor to clean off the residual toner material which is then collected in a generally enclosed chamber below. In the second position the blade assembly is spaced apart from the photoreceptor but covers the entrance to the chamber forming a sealed enclosure for the contents. Thus, the toner collecting chamber is sealed by the cleaner blade alone without relying on the photoreceptor to perform a sealing function which makes the apparatus particularly suitable for use in a process cassette including at least a photoreceptor and, optionally, other process elements wherein the photoreceptor cannot seal the chamber because it is only loosely retained when the cassette is not in the working position in the machine.

U.S. Pat. No. 4,516,850 discloses a toner cleaning unit is provided for use in an electrophotographic copying machine to remove residual toner from a photosensitive drum after the transfer of a toner image onto a copy sheet and prior to formation of another electrostatic latent image thereon. The unit includes a cleaning blade which is disposed for selective contact with the photosensitive drum to collect any residual toner, and an intercept member disposed adjacent to the blade for intercepting any toner which might freely fall from a pile of toner defined in the region of contact between the blade and the drum. By moving the blade away from the photosensitive drum, the pile of toner may be conveyed to a developing unit as the drum rotates.

SUMMARY OF THE INVENTION

In accordance with one aspect of the present invention, there is provided an assembly for use in a development unit. The assembly includes a member and a mechanism. The member defining a free edge thereof. The mechanism is used for translating the member in a direction along the free edge.

In accordance with another aspect of the present invention, there is provided a developer unit for developing a latent image with marking particles. The developer unit includes a housing defining a chamber for storing a supply of marking particles therein and an advancing member for advancing the marking particles on a surface thereof from the chamber of the housing in a first direction toward the latent image. The developer unit also includes a controlling member for at least one of charging the marking particles and regulating the thickness of the layer of marking particles on the surface of the advancing member, the controlling member defining a free edge thereof. The developer unit also includes a mechanism for translating the controlling member in a direction along the free edge.

In accordance with another aspect of the present invention, there is provided a process cartridge for use in a printing machine. The process cartridge includes a housing defining a chamber for storing a supply of marking particles therein and an advancing member for advancing the marking particles on a surface thereof from the chamber of the housing in a first direction toward the latent image. The developer unit also includes a controlling member for at least one of charging the marking particles and regulating the thickness of the layer of marking particles on the surface of the advancing member, the controlling member defining a free edge thereof. The developer unit also includes a mechanism for translating the controlling member in a direction along the free edge.

In accordance with yet another aspect of the present invention, there is provided an electrophotographic printing machine of the type including a developer unit. The developer unit includes a housing defining a chamber for storing a supply of marking particles therein and an advancing member for advancing the marking particles on a surface thereof from the chamber of the housing in a first direction toward the latent image. The developer unit also includes a controlling member for at least one of charging the marking particles and regulating the thickness of the layer of marking particles on the surface of the advancing member, the controlling member defining a free edge thereof. The developer unit also includes a mechanism for translating the controlling member in a direction along the free edge.

In accordance with yet another aspect of the present invention, there is provided a method for developing a latent image with marking particles. The method includes the steps of providing a housing defining a chamber for storing a supply of marking particles therein, advancing the marking particles with an advancing member on a surface thereof from the chamber of the housing in a first direction toward the latent image, performing at least one charging the marking particles and regulating the thickness of the layer of marking particles on the surface of the advancing member with a controlling member, and translating the controlling member with respect to the advancing member to provide for uniform wear of at least one of the advancing member and the controlling member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
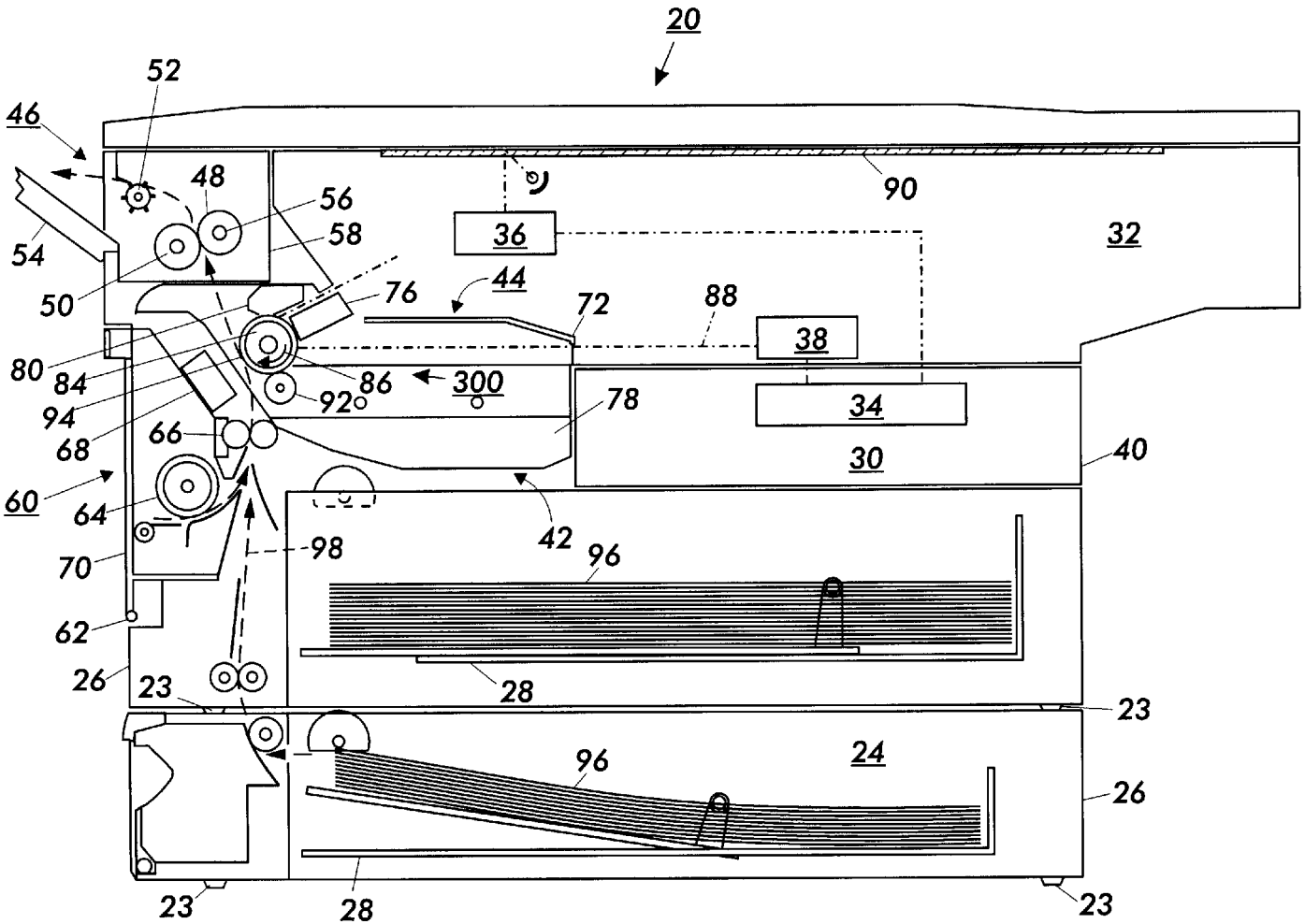
FIG. 5 is a front vertical illustration of an exemplary compact electrostatographic reproduction machine which may incorporate the translating tribocharging blade in accordance with the present invention.
Figure 6:
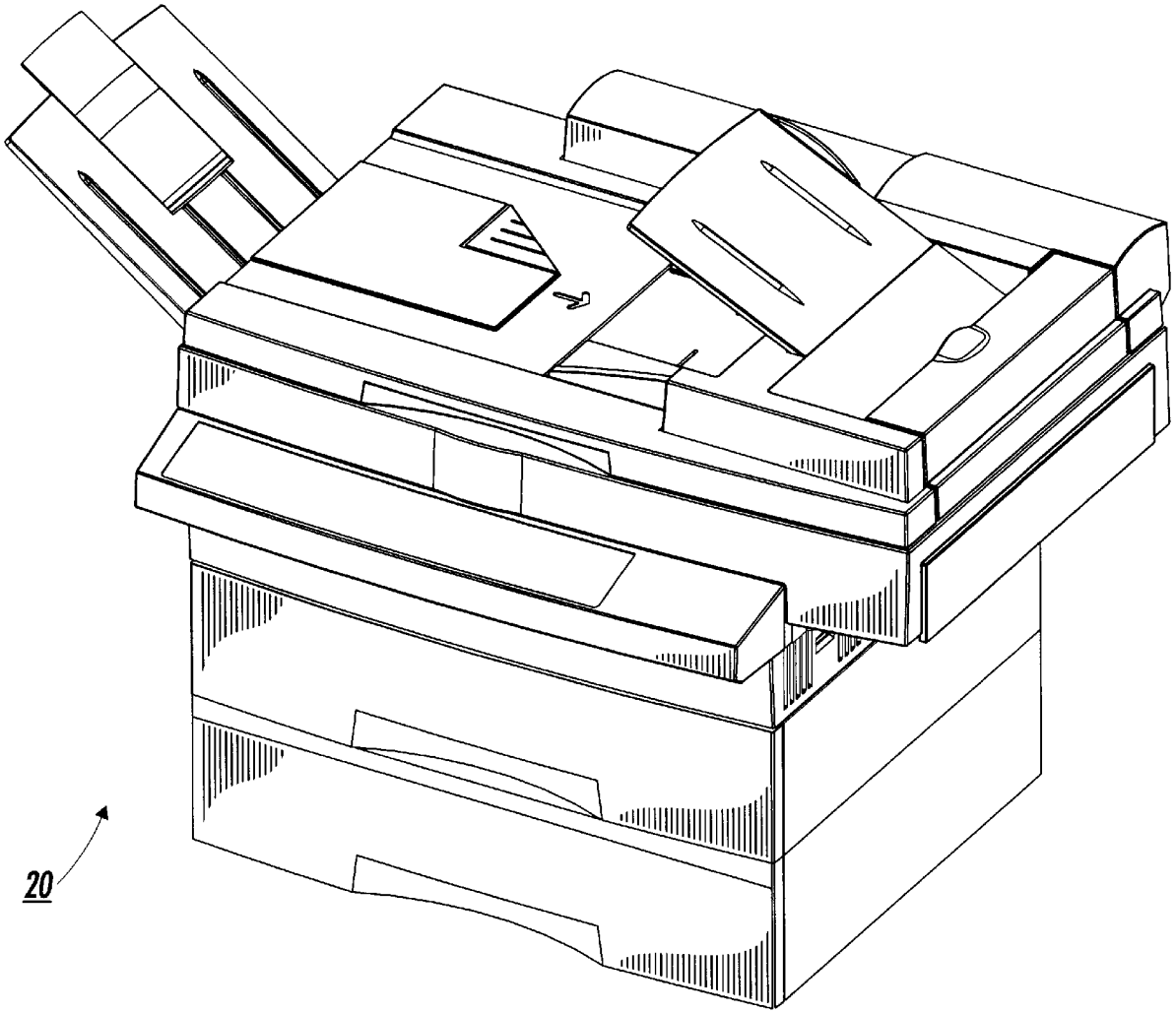
FIG. 6 is a perspective view of the machine of FIG. 5.

Referring now to FIGS. 5 and 6, there is illustrated a frameless exemplary compact electrostatographic reproduction machine 20 including separately framed mutually aligning modules. The compact machine 20 may be frameless, meaning that it does not have a separate machine frame to which electrostatographic process subsystems are assembled, aligned to the frame, and then aligned relative to one another as is typically the case in conventional machines. Instead, the architecture of the compact machine 20 includes a number of individually framed, and mutually aligning machine modules that variously include pre-aligned electrostatographic active process subsystems.

As shown, the frameless machine 20 may include a framed copy sheet input module (CIM) 22. Preferably, the machine 20 includes a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next includes a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. The ECS/PS module 30 may include a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 may include a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 may include a framed fuser module 46, that is mounted above the process cartridge module 44, as well as adjacent an end of the imager module 32. The fuser module 46 includes a pair of fuser rolls 48, 50, and at least an exit roll 52 for moving an image carrying sheet through, and out of, the fuser module 46 into an output or exit tray 54. The fuser module may also include a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The door module 60 includes active components including a bypass feeder assembly 64, sheet registration rolls 66, toner image transfer and detack devices 68, and the fused image output or exit tray 54. The door module 60 may include drive coupling components and electrical connectors (not shown), and a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

Referring again to FIG. 5, the CRU or process cartridge module 44 generally includes a module housing subassembly 72, a photoreceptor subassembly (not shown), a charging subassembly 76, a developer subassembly 78 including a source of fresh developer material, a cleaning subassembly 80 for removing residual toner as waste toner from a surface of the photoreceptor, and a waste toner sump subassembly (not shown) for storing waste toner. The module housing subassembly 72 of the CRU or process cartridge module 44 importantly provides and includes supporting, locating and aligning structures, as well as driving components for the process cartridge module 44.

Referring still again to FIG. 5, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roll 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

Figure 7:
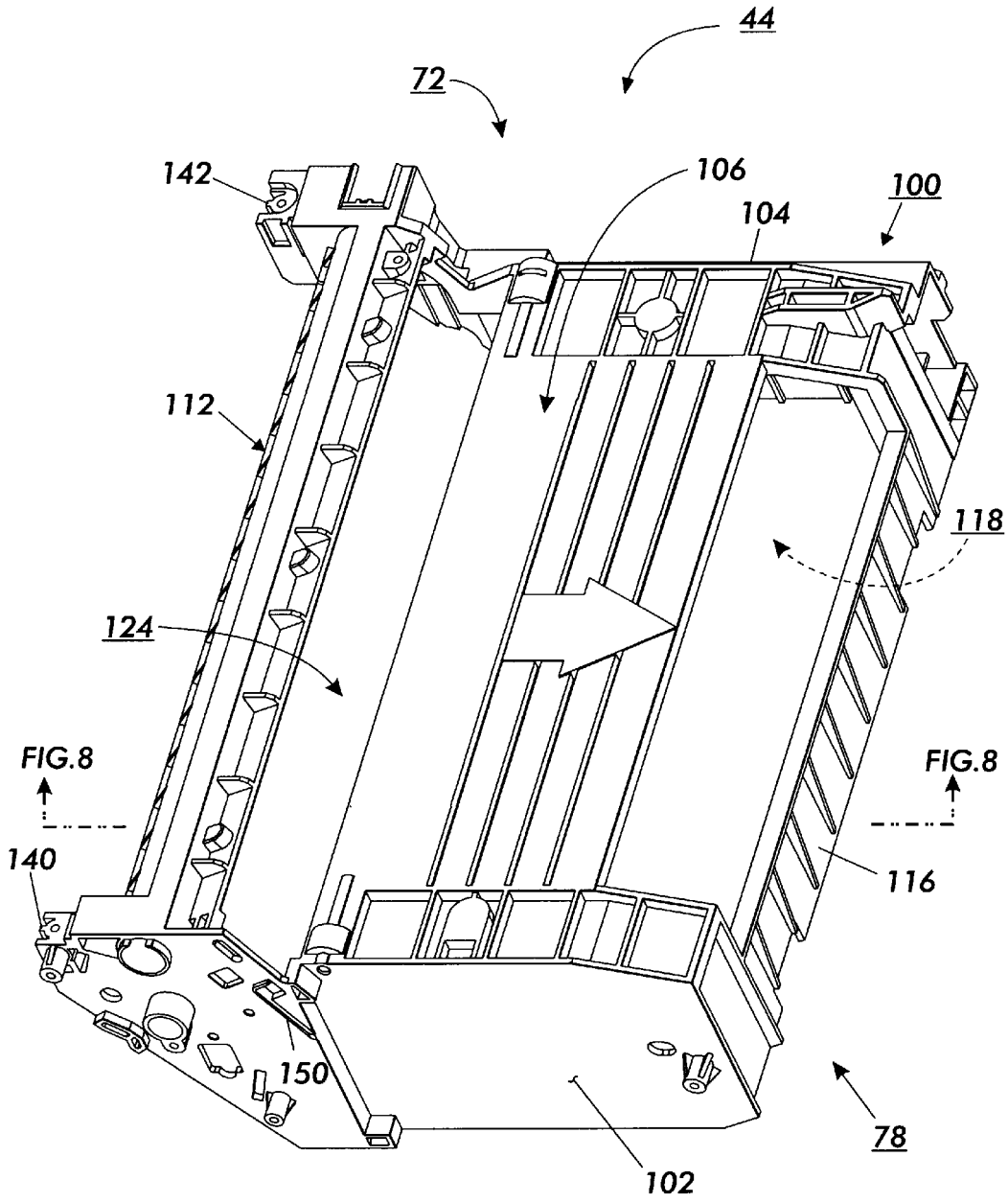
FIG. 7 is a top perspective view of a process cartridge or customer replaceable unit which may incorporate the translating tribocharging blade in accordance with the present invention and may be utilized in the machine of FIG. 5.
Figure 8:
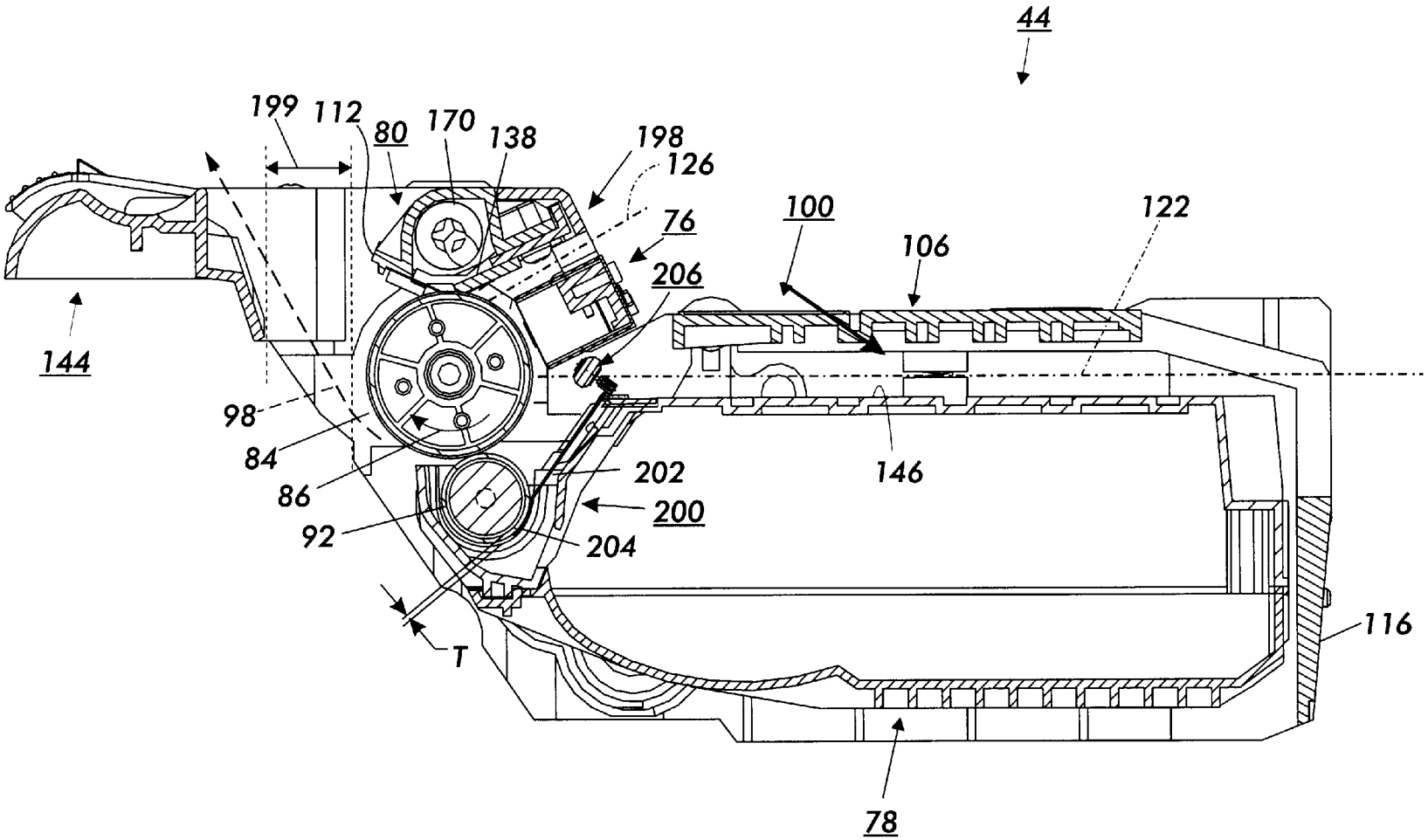
FIG. 8 is a vertical section (front-to-back) of the process cartridge of FIG. 7.

Referring now to FIGS. 7 and 8, a vertical (rear-to-back) section of the CRU or process cartridge module 44 as viewed along the plane 8—8 of FIG. 7 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, forms a portion of the sheet or paper path 98 of the machine 20 (see FIG. 5) by being spaced a distance 199 from photoreceptor 84 in the raised rear end 112 of the module housing 100. The photoreceptor or drum 84 is mounted to the side walls 102, 104, and as shown is located within the raised rear end 112 and is rotatable in the direction of the arrow 86. The charging subassembly 76 is mounted within the second cutout 124 in the top wall 106 and includes the slit 198 defining part of the second light path 126 for erase light (not shown) to pass to the photoreceptor 84.

Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (see FIG. 5). The first light path 122 is located so as to be incident onto the photoreceptor at a point downstream of the charging subassembly 76.

According to the present invention and referring now to FIG. 8, a blade assembly 200 is shown. The blade assembly 200 is utilized as shown in Figure eight in development unit 78. The blade assembly includes the blade 202. The blade 202 defines a free edge 204 on one end thereof. The blade assembly 200 further includes a mechanism 206 for translating the blade 200 in a direction along the free edge 204.

The blade 200 may have any shape and configuration and capable of the rich latent the fifth of the layer of marking particles on the surface of a magnetic developer roll on 92. The free edge 204 is utilize particles and for regulating the thickness of the layer of marking particles on the surface of the periphery of the developer roll 92. During operation of the developer unit 78, the free edge 204 of the regulating blade 202 is spaced a distance T from the surface of the magnetic developer roll 92.

While the regulating blade 202 and may, as shown in FIG. 8, have a generally planar shape, it should be appreciated that the regulating blade 202 may have any shape which may charge the marking particles and regulate the thickness of the marking particles. For example the regulating blade may be cylindrical or rectangular.

The mechanism 206 may be any mechanism capable of translating the regulating blade 202 along its free edge 204. For example the mechanism 200 may include a cam (not shown), a solenoid (not shown), or an electrical motor (not shown).

Figure 3:
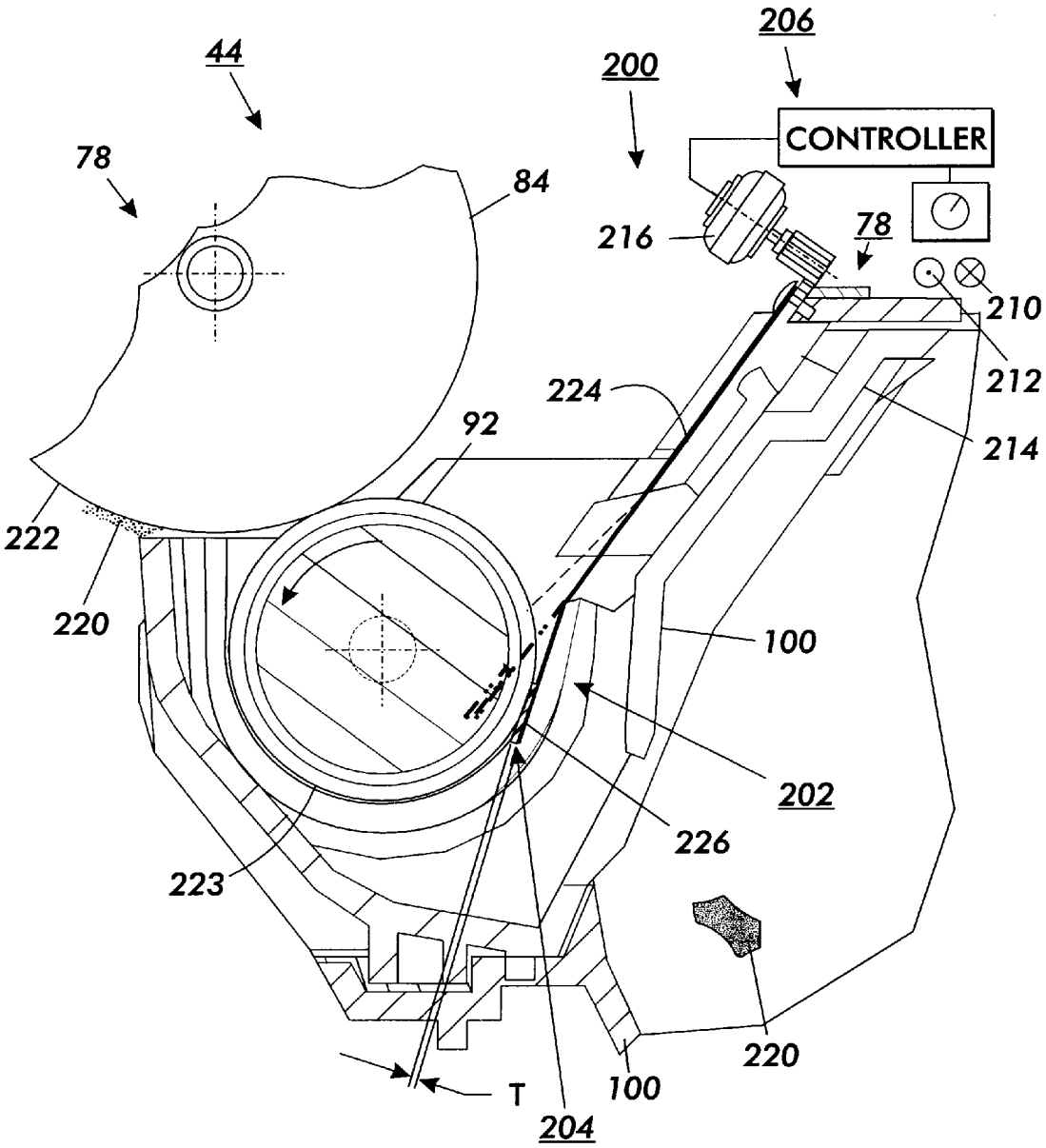
FIG. 3 is a partial enlarged view of FIG. 8 showing the magnetic roll and the translating tribocharging blade of FIG. 2 of the present invention mounted in the process cartridge of FIG. 7.

Referring now to FIG. 3, the blade assembly 200 is shown in greater detail. The blade assembly 200 is utilized as shown in FIG. 3 in a developer unit 44. The developer unit 44 as shown in FIG. 3 is part of a process cartridge or developer sub-assembly 78. It should be appreciated, however, that the blade assembly 200 may be utilized in any type of developer unit including that which is part of a process cartridge in that which is a integral part of a copy or printing machine.

As shown in FIG. 3, the blade assembly 200 includes the member 202. The member 202 includes the free edge 204 of the member 202. The blade assembly 200 also includes the mechanism 206 for translating the member 202 in a first direction 210 along the free edge 204.

The mechanism 206 may be any mechanism capable of moving the blade assembly 200 in the first direction 210. Preferably, and as shown in FIG. 3, the mechanism 206 also is utilized to move the blade assembly 200 in a second direction 212 opposite the first direction 210. As shown in FIG. 3, preferably a guide 214 is positioned between the blade assembly 200 and the module housing 100. The guide 214 serves to limit the motion of the blade assembly 200 to a direction along arrows 210 and 212.

The mechanism 206 may be any mechanism capable of translating the blade assembly 200. For example, the mechanism 200 may include a gear or a plurality of gears, a cam or a plurality of cams, a solenoid, or an electrical motor. It should be appreciated that the mechanism 206 may include a mixture of some or even all of the aforementioned mechanical components. The mechanism 206 may be actuated manually by the printer or copier operator or as shown in FIG. 3, the automatically actuated by, for example, an electric motor 216. The electric motor is mechanically connected to the mechanism 206 which is in turn is mechanically connected to the blade assembly 200 to permit the motion of the blade assembly 200.

The assembly 200 may be utilized in a copy or printing machine for translating the free edge of a member in the direction of the free edge. The member may be any member within the copier/printing machine which includes a free edge. For example, as shown in FIG. 3, the member 202 may be adapted to cooperate with a development roller 92. The mechanism 206 may be cooperable with the development roll 92 to translate the blade assembly 200 simultaneously with the rotation of the development roll 92.

The translation of the blade 202 of the blade assembly 200 by the mechanism 206 may either be continuous or intermittent. If the motion of the blade 202 is continuous, preferably, the motion of the blade 202 is relatively slow with a motion of, for example, 0.01 to 0.20 inches per minute. It should be appreciated, however, that translational speeds of the blade 202 may be greater than the preferred range and still fall within the scope and spirit of the invention. Preferably the maximum translational motion is significantly less than the magnetic roll motion.

In one embodiment, the blade 202 may move the same distance each time it translates. In another embodiment the blade 202 may have a motion that would be variable based on a predetermined cycle or randomly variable for each translating cycle. The controller may be used to control the variable motion of the blade 202 by the motor 216.

Preferably, the translation of the blade 202 is intermittent, occurring for example as frequently as once per second to as infrequently as one per day depending on the application. Preferably, when intermittent, the motion of the blade 202 occurs when the copying or printing machine is not in the process of developing a latent image into a developed image. For example, the blade 202 may be translated while the copy or printing machine is being warmed up or during another part of the xerographic process, for example, during exposure of the photoconductive drum, charging or during fusing. The speed of the translation of the blade 202 when intermittent may be performed at any speed for which the mechanism 206 is capable. This is particularly true if the translation occurs when the developer roll 92 is not developing a latent image upon the photoconductive member.

The blade 202 may, for example, pulse when the blade 202 is in contact with the drum 92 and when the drum 92 does not have a latent image on the contact portion of the drum 92 (in the interdocument gap). For example, in a typical copier or printer given a 50 millimeter magnetic roll and long edge feed, the frequency of the blade translation would be approximately once every 1.2 seconds.

While it should be appreciated that the length of travel of the blade 202 along the direction of arrows 210 and 212 may be any distance sufficient to provide for a more uniform wearing of the item which cooperates with the free edge 204 of the blade assembly 200, it should be appreciated that shorter travel of the blade 202 is preferred to reduce the cost of the blade assembly 200, to assure the minimal loss of accuracy and integrity within the xerographic process caused by the translation of the blade assembly and to minimize the amount of time for the blade 202 to translate. The applicants have found that the wear of the free edge tool for the blade assembly 200 can be minimized with a translation of the blade 202 a distance of, for example, 0.02 to 0.50 inches. A motion of the blade 202 of from about 0.02 to 0.10 inches is preferred.

The member 200 may have any shape and configuration capable of regulating the thickness of the layer of marking particles 220 on the surface 222 of the magnetic developer roller 92. The member 202 includes the free edge 204 for charging the marking particles 220 and for regulating the thickness of the layer of marking particles 220 on the surface 222 of the magnetic developer roller 92. During operation of the developer unit 78, the free edge 204 of the member 202 is spaced distance T from the surface 222 of the magnetic developer roller 92.

While the blade 202 may have any suitable shape and may be made of any suitable material capable of charging the marking particles 220 and regulating the thickness of the layer of marking particles 220 on the surface 222 of the magnetic developer roller 92, preferably, for simplicity, the member 202 may include a metal body 224 operably connected to the modular housing 100. The body 224 is preferably made of a resilient material, for example a metal. The body 224 includes the free edge 204 hereof. The member 202 preferably also includes a tip 226 which is attached to the free edge 204 of the body 224. The tip 226 includes the free edge 204 of the member 202. The free edge 204 of the tip 226 is spaced from surface 223 of the magnetic developer roller 92 such that developer material may be carried by the magnetic developer roll 92 along the surface 223 thereof and such that the roll 92 and the member 202 may rub the marking particles 220 positioned therebetween and thereby charge the marking particles 220.

In one embodiment of the invention, the blade may be actuated on one end and a return spring (not shown) on the other end. The acutation may be made either mechanically or electrically. A mechanical actuation may be made by a cam/follower (694, 696) (see FIG. 12), while an electrical actuation may be made by a solenoid (470) (see FIG. 10).

Figure 4:
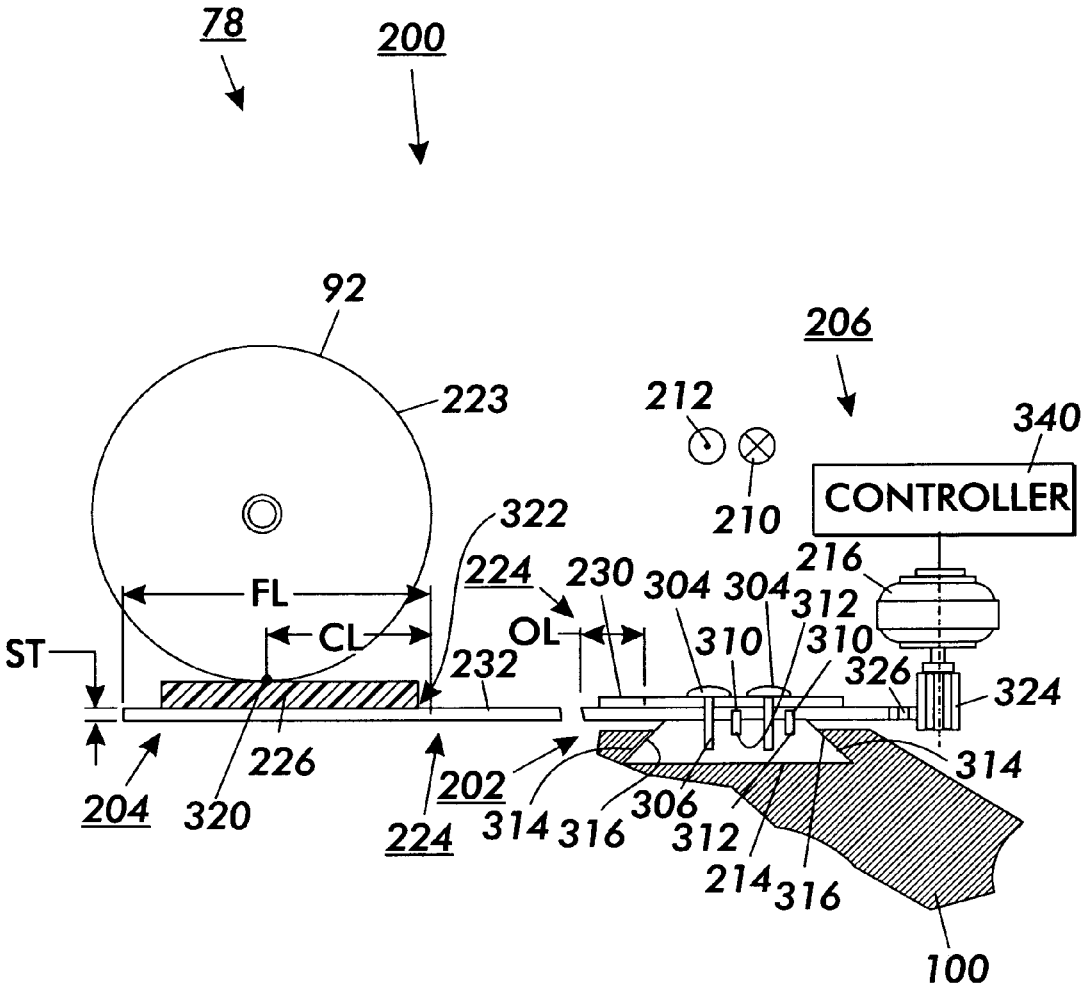
FIG. 4 is a partial enlarged view of the translating tribocharging blade of FIG. 3 in greater detail.

Referring now to FIG. 4, the blade assembly 200 is shown in greater detail. To provide proper pliability to the body 224 of the blade 202 and to adequately secure the body 224 to the housing 100, preferably, the body 224 includes a sheet metal portion 230 which is attached to the housing 100 and a pliable portion 232 which is secured to the sheet metal portion 230. The body 224 of the blade 202 may be made of any suitable durable material which is resilient. For example, the body 224 may be made of a resilient plastic or a resilient metal. For example, the body 224 may be made of a metal. The sheet metal portion 230 of the body 224 may be made, for example, of sheet metal. The pliable or resilient portion 232 of the body 224 may be made of any resilient material, for example, a plastic or a metal. Preferably, the resilient portion 232 is made of a pliable stainless steel.

The stainless steel portion 232 is secured to the sheet metal portion 230 in any suitable fashion. For example, as shown in FIG. 4, fasteners in the form of screws 304 may be fitted through clearance holes 306 located in the stainless steel portion 232 and in the sheet metal portion 230. The screw 304 may be threadably attached to the housing 100.

To assure that the blade 202 is accurately positioned with respect to the housing 100, preferably, the sheet metal portion 230 of the body 224 includes location holes 310 which mate with positioning pins 312 which may, for example, be located in the guide 214.

The guide 214 may have any suitable shape capable of providing for linear motion of the blade assembly in the direction of arrows 210 and 212. For example, the guide 214 may be in the form of ways or gibs having, for example, a trapezoidal cross section having outside faces 314 which mate with internal faces 316 in the housing 100. The stainless steel portion 232 may be further secured to the sheet metal portion 230 by the application of an adhesive (not shown) positioned between the stainless steel portion 232 and the sheet metal portion 230. The adhesive serves to provide a more secure and complete connection between the stainless steel portion and the sheet metal portion 230 so that the deflection of the tip 226 may be more accurately controlled. The stainless steel portion 232 preferably overlaps the sheet metal portion 230 and may overlap a distance OL of, for example, 0.40 inches.

The stainless steel portion 232 preferably is cantilevered and overhangs the sheet metal portion 230. The stainless steel portion has a free length FL of say, for example, 0.70 inches. The free length is chosen together with the thickness ST of the stainless steel portion 232 to provide for a particular force between the roll 92 and the tip 226. For example, for a free length FL of 0.70 inches the thickness ST of the stainless steel portion 232 may be, for example, 0.002 inches.

The tip 226 may be made of any suitable durable material that is pliable. For example, the tip 226 may be made of a plastic or a rubber. For example, the tip 226 may be made of silicone rubber or polyurethane material.

The tip 226 may be secured to the stainless steel portion 232 by any suitable means; preferably, the tip 226 is secured to the stainless steel portion 232 by an adhesive (not shown). The adhesive may be any adhesive capable of securing the tip 226 and not being chemically reactive with the marking particles 220.

The tip 226 may be tangentially contactable with the outer surface 223 of the magnetic developer roll at contact point 320. It should be appreciated that in operation, the tip 226 is spaced from the roll 92 so that the marking particles 220 may be regulated and charged by passing therebetween. Contact point 320 may be, for example, positioned at a distance of, for example, CL from the inner edge 322 of the plastic member 226 of, for example, 0.60 inches.

While the mechanism 206 may have any suitable form capable of translating the blade 202 in the direction of arrows 210 and 212, as for example, as shown in FIG. 4, the mechanism 206 may include the motor 216 which is connected to a pinion gear 324. The pinion gear 324 meshes with rack gear 326 connected to the blade 202.

Figure 1:
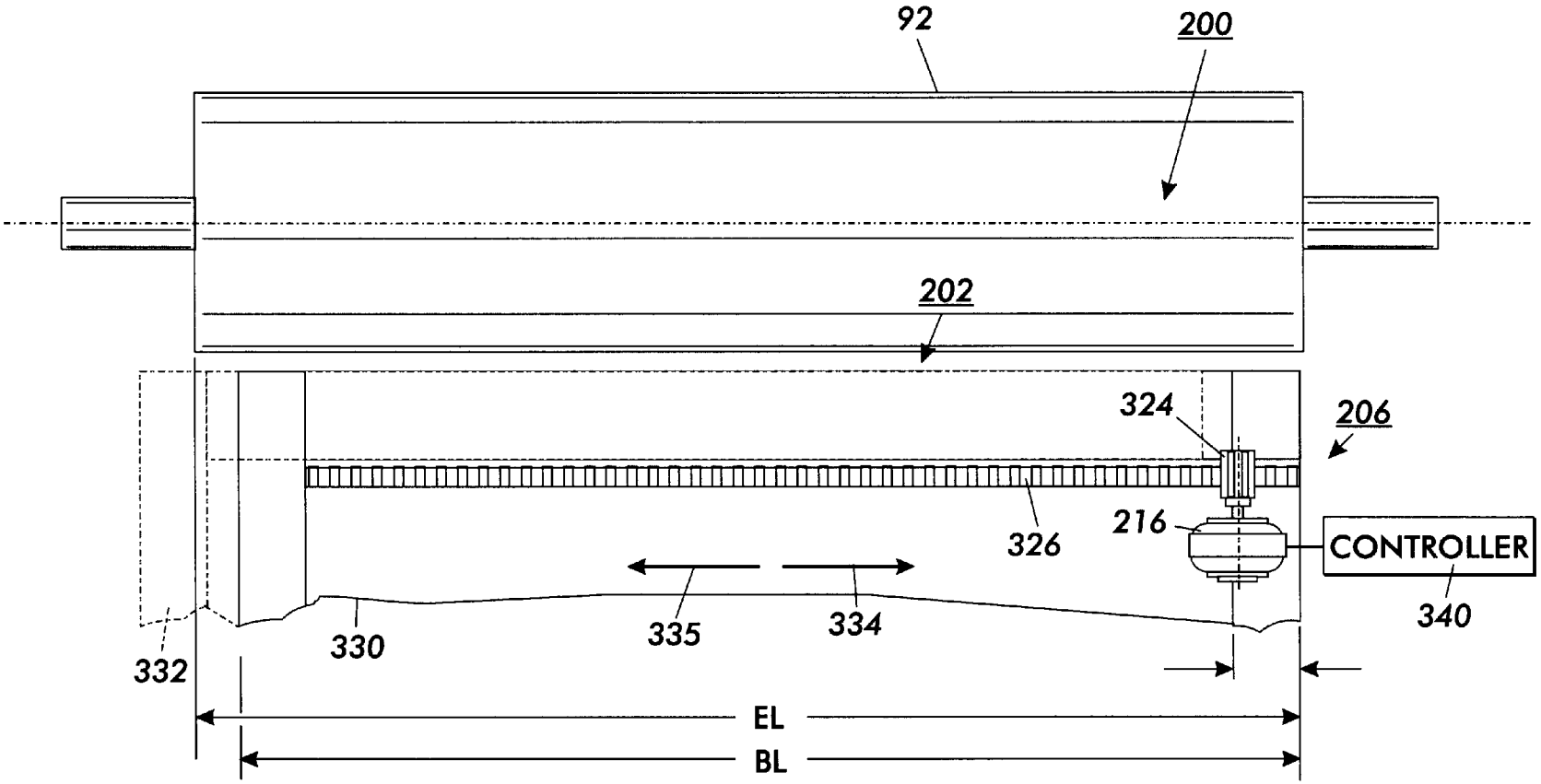
FIG. 1 is a schematic view of a translating tribocharging blade according to the present invention in contact with a magnetic developer roll.

Referring now to FIG. 1, the blade assembly 200 is shown in solid in first position 330 and in phantom in the second position 332. As shown in FIG. 1, the mechanism 206 includes the motor 216 in the form of a two directional motor or a positioning motor which permits motion of the rack 326 connected to the blade 202. As the blade 202 translates in the direction of first arrow 334, the blade 202 moves to first position 330. As the motor 216 causes the pinion to rotate in the direction of arrow 335, the blade 202 moves in the direction of second arrow 335 to the second position 332. The rotation of the motor 216 may be controlled, for example, by a controller 340. The controller 340 may be as simple as a button or switch or may be a complicated integrated circuit or computer.

The blade 202 of the blade assembly 200 has length BL such that opposed ends of the blade 202 extend beyond the effective length EL of the magnetic roll. Providing a blade 202 with a blade length BL sufficient to extend over the effective length of the magnetic roll 92, assures that the entire circumference of the magnetic roll 92 will be properly coated with magnetic particles 222.

Figure 9:
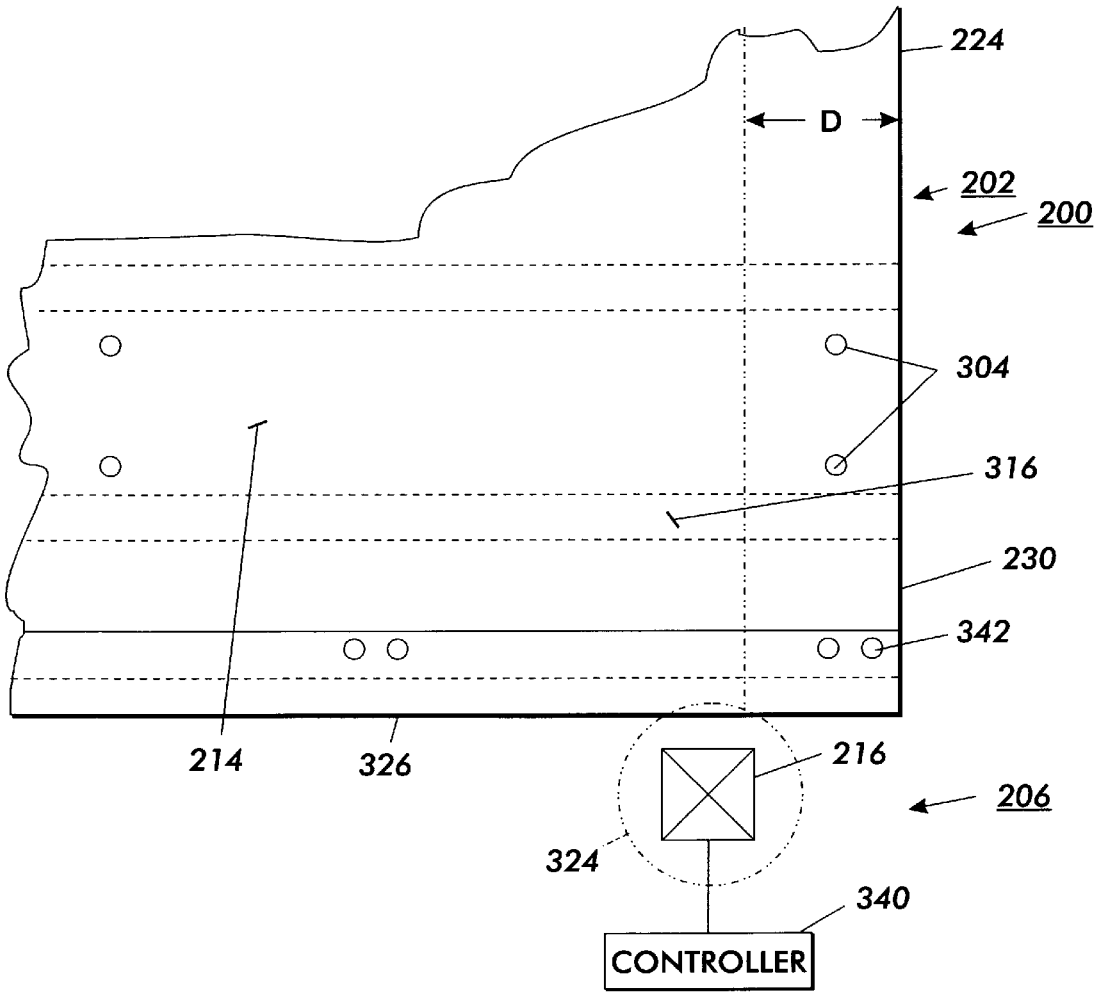
FIG. 9 is a partial schematic view of the translating tribocharging blade of FIG. 4 in accordance with the present invention utilizing a rack and pinion drive.

Referring now to FIG. 9, the mechanism 206 is shown in greater detail. The rack 326 may be integral with the sheet metal portion 230 of the body 224 of the blade 202 or as shown in FIG. 9, may be in the form of a separate of piece which may be connected by screws 342 connecting the rack 326 to the sheet metal portion 230 of the blade 202.

Figure 2:
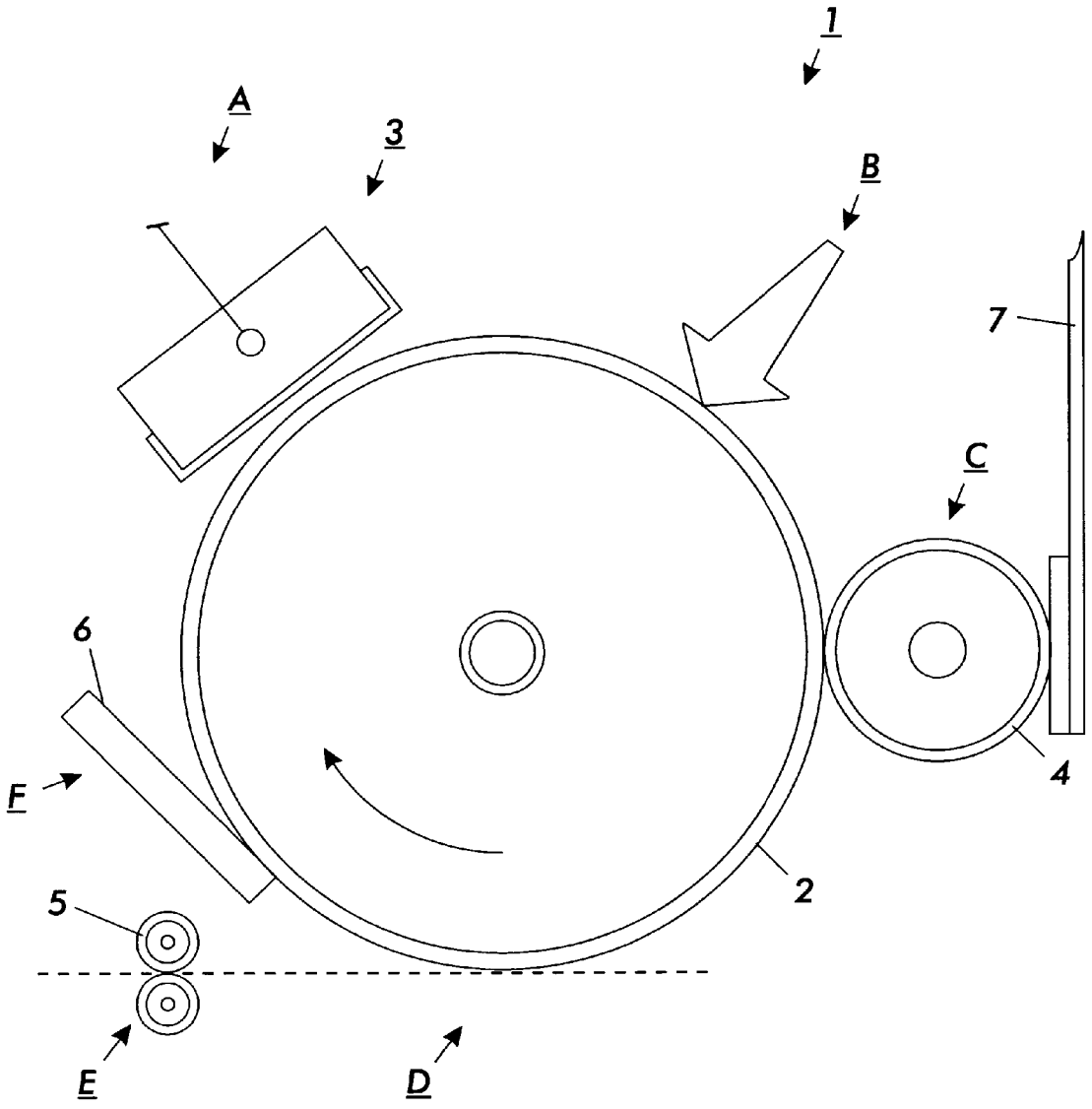
FIG. 2 PRIOR ART
FIG. 2 is a schematic view of a prior art printing machine.
Figure 10:
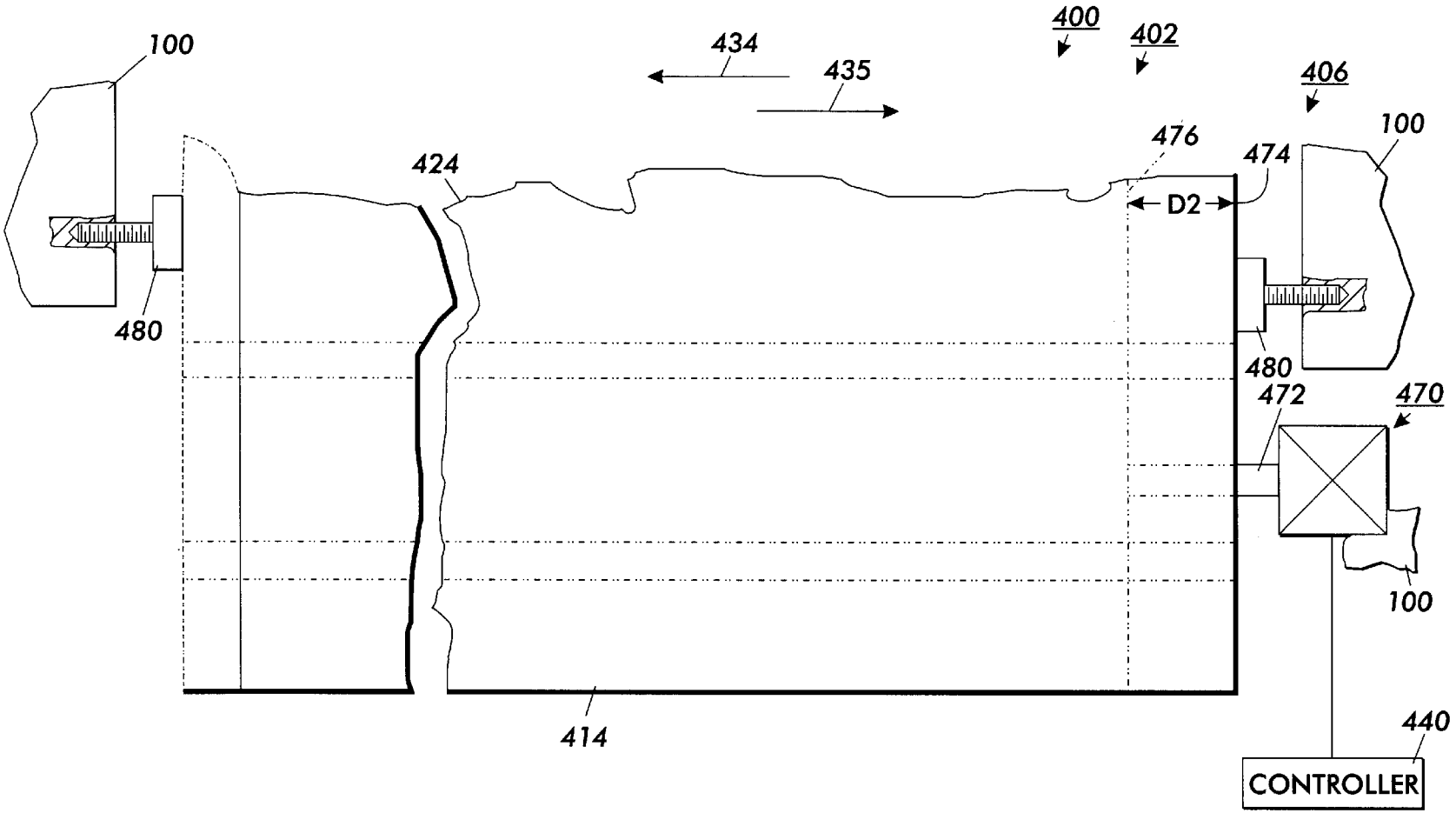
FIG. 10 is a partial schematic view of an embodiment of a translating tribocharging blade in accordance with the present invention utilizing a solenoid.

Referring now to FIG. 10, an alternate embodiment of the present invention is shown as blade assembly 400. Blade assembly 400 is similar to blade assembly 200 of FIG. 1 and 2 except that blade assembly 400 utilizes a solenoid 470 for translating the blade assembly 400. The blade assembly 400 includes a blade 402 that is translatable in the directions of arrows 435 and 434 along guide 414. Guide 414 is similar to guide 314 of FIGS. 1 and 2. Body 424 is connected to the guide 414 and is movable therewith. The guide 414 is connected to developer housing 400. The blade 402 is movable by means of a mechanism 406, which is similar to mechanism 206 of FIGS. 1 and 2 except that mechanism 406 is actuated by the solenoid 470. The solenoid 470 is secured to the developer housing 400 and includes a plunger 472 which displaces the body 424 of the blade 402 a distance D2 from first position 474 to second position 476 as shown in phantom. Stops 480 may be utilized to more accurately limit the travel of the body 424 of the blade 402. Actuation of the solenoid 470 may be controlled by, for example, controller 440. The controller 440 may be a simple switch or a more complicated computer.

Figure 11:
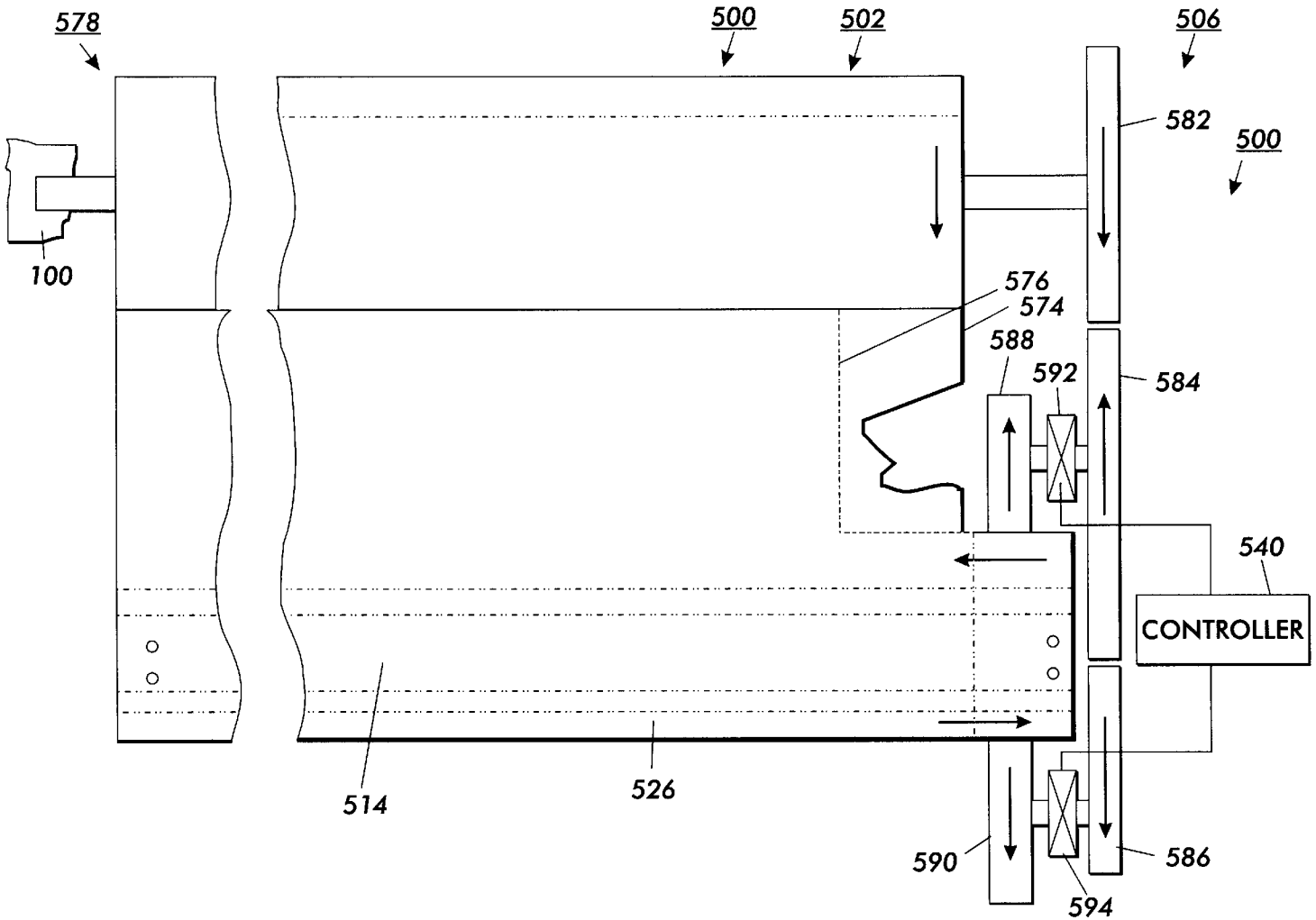
FIG. 11 is a partial schematic view of another embodiment of a translating tribocharging blade in accordance with the present invention utilizing a drive train including clutches.

Referring now to FIG. 11, another alternate embodiment of the present invention is shown as blade assembly 500. Blade assembly 500 is similar to blade assembly 400 in FIG. 10 except that blade assembly 500 utilizes a mechanism 506, which is different than mechanism 406 of FIG. 10. In fact, mechanism 506 utilizes series gears and clutches to provide for the translating of charging blade 502.

The blade assembly 500 includes a blade 502 similar to blade 402 of FIG. 10. The blade translates and is restrained by guide 514, which is similar to guide 414 of FIG. 10. The guide 514 is mounted to developer housing 100. The blade assembly 500 is mounted to developer sub-assembly 578. The developer sub-assembly 578 includes a gear train a first gear 582 and a second gear 584 and a third gear 586.

The gears 582, 584 and 586 are utilized to transfer torque from the developer roll 92 to fourth gear 588 and fifth gear 590. First and second clutches 592 and 594, respectively, are utilized to energize selectively the fourth gear 588 and the fifth gear 590. A controller 540 similar to controller 440 of FIG. 10 is utilized to engage the first clutch 592 and the second clutch 594 so that the fourth gear 588 or fifth gear 590 may be activated. As shown in FIG. 11, the fourth gear 588 and the fifth gear 590 are helical gears which mate with helical gear portions on rack 526 which is similar to rack 326 of FIG. 4. Rack 526 however includes helical teeth so that the helical teeth of the rack 526 may mesh with the helical teeth of the fourth gear 588 and the fifth gear 590.

By utilizing the controller 540 to selectively engage the first clutch 592 and the second clutch 594, the blade 502 may be moved from a first position 574 as shown in solid to a second position 576 shown in phantom. It should be appreciated that the mechanism 506 may likewise be utilized to move the blade 502 from the second position 576 to the first position 574.

Figure 12:
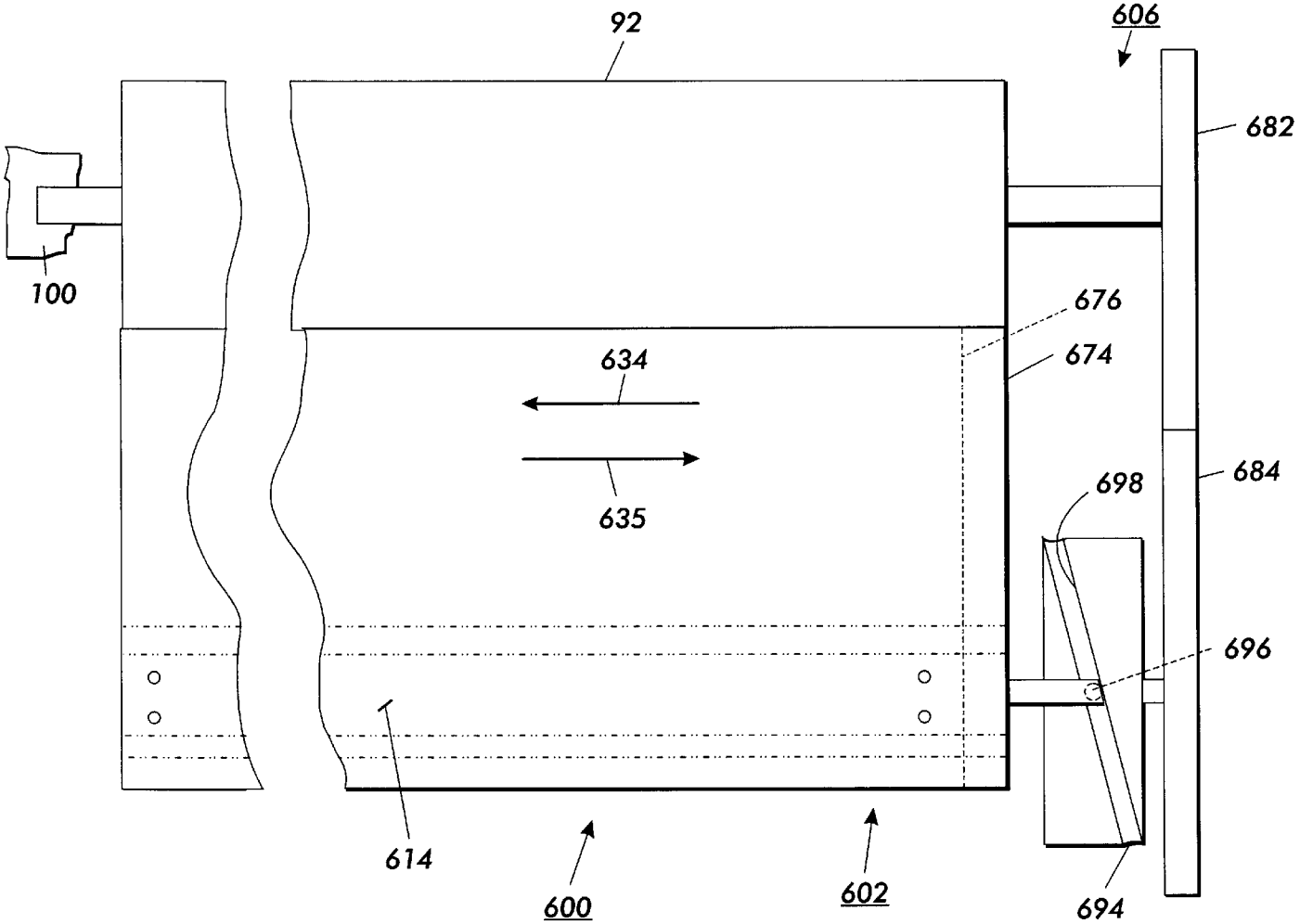
FIG. 12 is a partial schematic view of another embodiment of a translating tribocharging blade in accordance with the present invention utilizing a drive train including a cam.

Referring now to FIG. 12, an alternate embodiment of the present invention is shown as blade assembly 600. Blade assembly 600 is similar to blade assembly 500 of FIG. 11 except that mechanism 606 is different than mechanism 506 of FIG. 11. Mechanism 606 utilizes a cam 694 and a follower 696 to move blade 602 from first position 674 as shown in solid to second position 676 as shown in phantom. The blade 602 is in cooperation with the developer roll 92. A gear train including a first gear 682 and a second gear 684 translates torque from the developer roll 92 to the cam 694. The follower 696 secured within channel 698 of the cam 694 moves the blade 602 in the direction of arrows 634 and 635 along guide 614.

Figure 13:
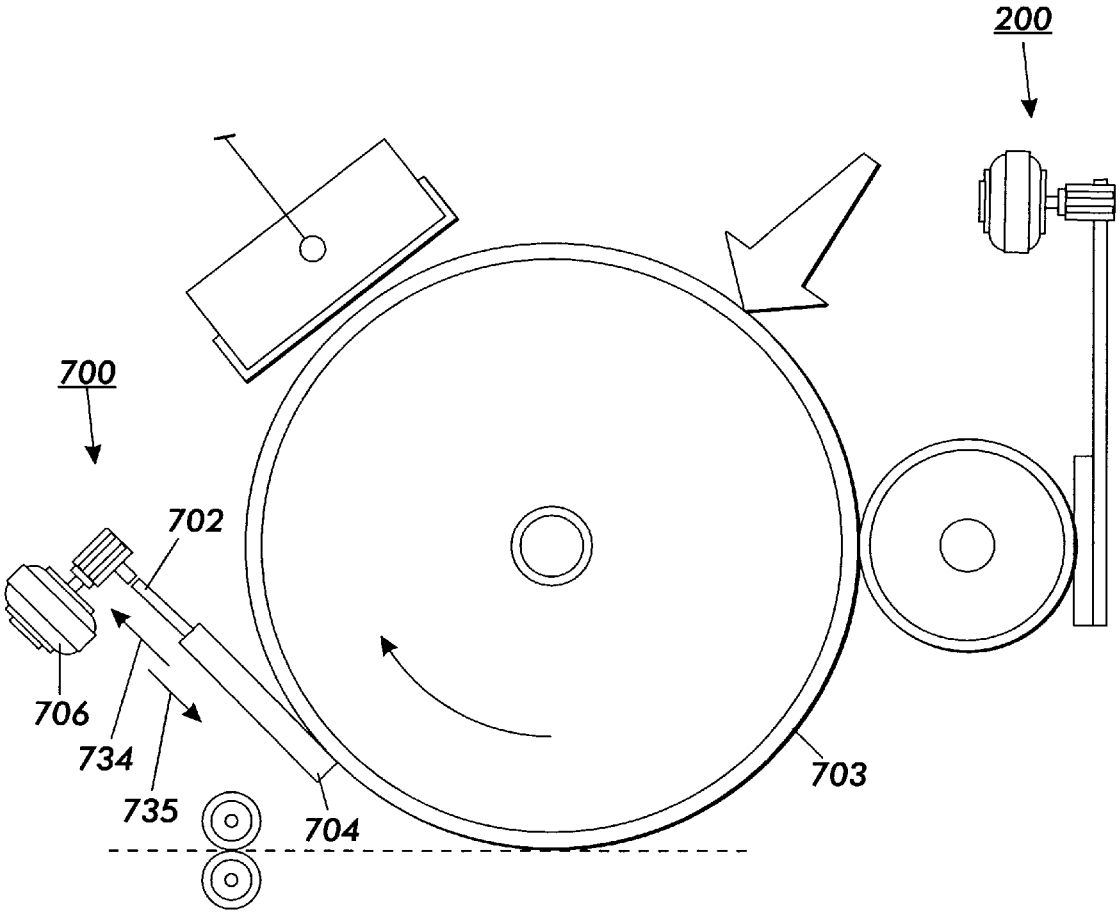
FIG. 13 is a schematic view of another embodiment of the present invention depicting a translating cleaning blade installed in an illustrative printing machine.

Referring now to FIG. 13 an alternate embodiment of the present invention is shown as blade assembly 700. Blade assembly 700 may be used in conjunction with the blade assembly 200 of FIGS. 1 and 2. Blade assembly 700 may be similar in construction to blade assembly 200 or similar to the construction of blade assembly 400, 500, or 600. Blade assembly 700 includes a mechanism 706 for translating a blade 702 in the direction of arrows 734 and 735 so that free edge 704 of the blade 702 contacts periphery of a photoconductive drum 703. The blade assembly 700 thus provides for even wear of the free edge 702 of a blade in contact with the photoconductive drum 703. The blade assembly 700 may be in the form of a cleaning blade or a charging blade.

By providing a tribocharging blade which translates along the contact zone of the blade, the wear on the charging blade may be reduced.

By providing a translating tribocharging blade, the life of the blade may be extended.

By providing a tribocharging blade which translates the maintenance cost associated with a copy or printing machine caused by the replacement and repair of the tribocharging blade may be reduced.

By providing a tribocharging blade that translates less down time and loss of service will be experienced on printing and copying machines.

By providing a tribocharging blade that translates along the length of the blade print quality will improve by providing less streaks and non-uniformity in the solid areas of a copy produced from a printing machine utilizing a translating While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An assembly for use in a development unit, said assembly comprising:

a member, said member defining a free edge thereof; and a mechanism for translating said member in a direction along said free edge;

wherein said member cooperates with a development roll; and wherein said mechanism is cooperable with the roll to translate said member simultaneously with a rotation of the roll.

2. An assembly as claimed in claim 1, wherein said mechanism comprises at least one of a cam, a solenoid and an electric motor.

3. An assembly as claimed in claim 1, wherein said member comprises:

a metal body; and a plastic tip secured to said body.

4. An assembly as claimed in claim 1, wherein said mechanism translates the member a distance ranging from between 0.02 and 0.50 inches.

5. An assembly as claimed in claim 1, wherein said member comprises a blade.

6. An assembly as claimed in claim 1 wherein the member comprises a tip secured to a body, the tip comprising at least one of a plastic, rubber, silicone rubber, and polyurethane material.

7. A developer unit for developing a latent image with marking particles, said developer unit comprising:

a housing defining a chamber for storing a supply of marking particles therein;

an advancing member for advancing the marking particles on a surface thereof from the chamber of said housing in a first direction toward a latent image; and a controlling member for at least one of charging the marking particles and regulating a thickness of a layer of marking particles on the surface of said advancing member, said controlling member defining a free edge thereof; and a mechanism for translating said controlling member in a direction along said free edge.

8. A developer unit as claimed in claim 7, wherein said mechanism comprises at least one of a cam, a solenoid and an electric motor.

9. A developer unit as claimed in claim 7:

wherein said controlling member cooperates with said advancing member; and wherein said mechanism is cooperable with said advancing member to translate said controlling member simultaneously with a rotation of said advancing member.

10. A developer unit as claimed in claim 7, wherein said controlling member comprises:

a metal body; and a plastic tip secured to said body.

11. A developer unit as claimed in claim 7, wherein said mechanism translates said controlling member a distance ranging from between 0.02 and 0.50 inches.

12. A developer unit as claimed in claim 7:

wherein said controlling member comprises a blade;

wherein said advancing member comprises a development roll defining an axis of rotation thereof; and wherein said controlling member is movable along a direction parallel to the axis of rotation of said advancing member.

13. A developer unit as claimed in claim 7, wherein said controlling member comprises a blade.

14. A developer unit as claimed in claim 7:

wherein said controlling member and said advancing member define a interaction zone therebetween; and wherein said mechanism translates said controlling member in a direction along said interaction zone.

15. A process cartridge for use in a printing machine comprising, said process cartridge including:

a housing defining a chamber for storing a supply of marking particles therein;

an advancing member for advancing the marking particles on a surface thereof from the chamber of said housing in a first direction toward a latent image; and a controlling member for at least one of charging the marking particles and regulating a thickness of a layer of marking particles on the surface of said advancing member, said controlling member defining a free edge thereof; and a mechanism for translating said controlling member in a direction along said free edge.

16. A process cartridge as claimed in claim 15, wherein said mechanism comprises at least one of a cam, a solenoid and an electric motor.

17. A process cartridge as claimed in claim 15:

wherein said controlling member cooperates with said advancing member; and wherein said mechanism is cooperable with said advancing member to translate said controlling member simultaneously with a rotation of said advancing member.

18. A process cartridge as claimed in claim 15, wherein said controlling member comprises:

a metal body; and a plastic tip secured to said body.

19. A process cartridge as claimed in claim 15, wherein said mechanism translates said controlling member a distance ranging from between 0.02 and 0.50 inches.

20. A process cartridge as claimed in claim 15:

wherein said controlling member comprises a blade;

wherein said advancing member comprises a development roll defining an axis of rotation thereof; and wherein said controlling member is movable along a direction parallel to the axis of rotation of said advancing member.

21. A process cartridge as claimed in claim 15, wherein said controlling member comprises a blade.

22. A process cartridge as claimed in claim 15:

wherein said controlling member and said advancing member define an interaction zone therebetween; and wherein said mechanism translates said controlling member in a direction along said interaction zone.

23. An electrophotographic printing machine of a type including a developer unit, said developer unit comprising:

a housing defining a chamber for storing a supply of marking particles therein;

an advancing member for advancing the marking particles on a surface thereof from the chamber of said housing in a first direction toward a latent image; and a controlling member for at least one of charging the marking particles and regulating a thickness of a layer of marking particles on the surface of said advancing member, said controlling member defining a free edge thereof; and a mechanism for translating said controlling member in a direction along said free edge.

24. A printing machine as claimed in claim 23, wherein said mechanism comprises at least one of a cam, a solenoid and an electric motor.

25. A printing machine as claimed in claim 23:

wherein said controlling member cooperates with said advancing member; and wherein said mechanism is cooperable with said advancing member to translate said controlling member simultaneously with a rotation of said advancing member.

26. A printing machine as claimed in claim 23, wherein said controlling member comprises:

a metal body; and a plastic tip secured to said body.

27. A printing machine as claimed in claim 23, wherein said mechanism translates said controlling member a distance ranging from between 0.02 and 0.50 inches.

28. A printing machine as claimed in claim 23:

wherein said controlling member comprises a blade;

wherein said advancing member comprises a development roll defining an axis of rotation thereof; and wherein said controlling member is movable along a direction parallel to the axis of rotation of said advancing member.

29. A printing machine as claimed in claim 23, wherein said controlling member comprises a blade.

30. A printing machine as claimed in claim 23:

wherein said controlling member and said advancing member define a interaction zone therebetween; and wherein said mechanism translates said controlling member in a direction along said interaction zone.

31. A method for developing a latent image with marking particles, comprising the steps of:

providing a housing;

defining a chamber for storing a supply of marking particles in the housing;

advancing the marking particles with an advancing member on a surface thereof from the chamber of the housing in a first direction toward a latent image;

performing at least one charging the marking particles and regulating a thickness of a layer of marking particles on the surface of said advancing member with a controlling member; and translating the controlling member with respect to the advancing member to provide for uniform wear of at least one of the advancing member and the controlling member.

* * * * *